US006585231B1

(12) United States Patent
Fratoni, Jr.

(10) Patent No.: US 6,585,231 B1
(45) Date of Patent: Jul. 1, 2003

(54) PNEUMATIC JACK

(76) Inventor: Anthony R. Fratoni, Jr., 113 Naples Rd., Revere, MA (US) 02151

( * ) Notice: Subject to any disclaimer, the term of this patent is extended or adjusted under 35 U.S.C. 154(b) by 0 days.

(21) Appl. No.: 10/167,977

(22) Filed: Jun. 12, 2002

(51) Int. Cl.[7] ..... B66F 3/24

(52) U.S. Cl. ..... 254/93 H; 254/423; 254/93; 405/282

(58) Field of Search ..... 254/423, 93 R, 254/93 H, 45, 133 A, 934 P; 61/41 A

(56) References Cited

U.S. PATENT DOCUMENTS 1,590,830 A * 6/1926 Jewkes ..... 254/93 R
3,321,182 A * 5/1967 Elenburg ..... 254/93
3,851,856 A * 12/1974 Berg ..... 254/93 R
5,232,206 A * 8/1993 Hunt ..... 254/423
5,465,940 A * 11/1995 Guzman ..... 254/423
5,499,890 A * 3/1996 Kishi ..... 405/282

* cited by examiner

*Primary Examiner*—Joseph J. Hail, III
*Assistant Examiner*—Daniel Shanley
(74) *Attorney, Agent, or Firm*—Joseph R. Birkner

(57) ABSTRACT

A pneumatic jack energized from a container having a pressurized gas therein for rapidly and effortlessly lifting an object such as a motor vehicle including an automobile, a van, and a truck for one purpose of changing a tire that has gone flat is disclosed. The pneumatic jack has a housing with a piston slideably disposed in a chamber therein cooperating with a lifting element, a hose connected between the housing and the container, a gas fill valve and a throttle valve for controlling the pressure to the piston for raising and for maintaining the lifted object in an elevated position and a handle pivotally connected to the housing for manipulating the pneumatic jack for placement under the motor vehicle.

9 Claims, 2 Drawing Sheets

PNEUMATIC JACK

FIELD OF THE INVENTION

This invention relates generally to a lifting apparatus for raising a body. More particularly, the present invention relates to a portable pneumatic operated jack for lifting an object such as an automobile so that a tire may be changed.

BACKGROUND OF THE INVENTION

Typically, automobile tires are changed by a motor vehicle owner by use of a bumper jack which is provided in the trunk of a vehicle. Operation is achieved by assembling the bumper jack components and placing them at a jacking location such as in a slot in the vehicle body, on the axle or on the bumper itself in close proximity to a wheel. When in place, the bumper jack is mechanically ratcheted with a handle until the vehicle is raised above the ground and the tire is accessible for servicing. Other types of mechanical bumper jacks utilize a hydraulic system to achieve the same result. A problem with such devices is that they must be hand assembled for use and are bulky which makes them cumbersome to operate, especially by car owners who infrequently experience a need to change a flat tire on the road. Furthermore, persons having limited strength can not operate such devices. Also, they are time consuming to operate, which can be dangerous to the operator especially during inclement weather and at night and when in high traffic areas. Ideally, if one experiences a flat tire on the road, especially in a remote area where there is limited service available, it is advantageous to have a jack which could instantaneously and safely lift a vehicle for tire changing without the problems associated with typical automobile bumper jacks.

No device is known such as a pneumatic jack that conveniently and instantaneously lifts a vehicle and which is simple in design, versatile and is easy to use.

In view of the above mentioned problems and limitations associated with lifting a vehicle for changing a tire, it was recognized by the present inventor that there is an unfulfilled need for an improved jack apparatus that can lift a vehicle and one which is simple in design, practical, fun to use and is economically manufactured.

Accordingly, it becomes clear that there is a great need for a pneumatic jack apparatus which overcomes the disadvantages associated with lifting a vehicle. Such a jack should be one that minimizes the time to lift a vehicle and one which eliminates the racheting operation and the hydraulic operation procedures associated with standard bumper jacks as well as eliminating the need for manual dexterity and upper arm strength needed to operate such devices.

SUMMARY OF THE INVENTION

It is therefore an object of this invention to provide a pneumatic jack for lifting a motor vehicle such as an automobile, a truck and a van for changing a tire which avoids the aforementioned bumper jack problems.

It is an object of this invention to provide a pneumatic jack which instantaneously lifts a motor vehicle when placed under a portion of the vehicle near a tire and upon operator activation of a valve by directing compressed gas contained in a refillable container to a piston.

It is another object of this invention to provide a pneumatic jack which operates without the need for a ratchet or a hydraulic component.

It is a further object of this invention to provide a pneumatic jack which may be manufactured from readily available materials by conventional manufacturing processes.

It is a still a further object of this invention to provide a pneumatic jack that is portable, light weight, simple in design, simple to manufacture, low in cost and fun to use.

This invention results from the realization that there is a great need for a pneumatic jack that can conveniently and effortlessly lift an object with minimum exertion by an operator. The resulting invention provides a user the capability of conveniently being able to safely and quickly raise a motor vehicle without the problems of having to assemble a bumper jack and to expend time and energy to lift the motor vehicle.

The above and the other objects are achieved in accordance with the present invention, which, according to a first aspect, provides a pneumatic jack for lifting an object such as an automobile, van or truck for roadside changing of a tire. The pneumatic jack has a housing having a passageway operationally cooperating with a chamber therein; a cover removably attached to the housing; a piston slideably disposed within the chamber; a lifting element disposed above the cover for engagement with an object to be lifted; a rod disposed between and connecting the piston and the lifting element. There are means for pneumatically actuating the pneumatic jack to raise and to maintain the object in an elevated position.

The second aspect is a special case of the first aspect of this invention with additional features. According to a second aspect of the invention the actuating means includes a container having a pressurized gas therein with a throttle valve disposed in close proximity to the container for introducing the pressurized gas into the passageway and into the chamber with a hose disposed between the throttle valve and the housing adjacent to the passageway. The container is removably attached from the throttle valve to allow the object to be lowered from an elevated position when the throttle valve is opened and to allow the container to be refilled with a gas fill valve on the container, as needed, with the pressurized gas chosen from the group consisting of $CO_2$, air and helium. The cover has a vent therein for purging residual air trapped in the chamber above the piston and between the cover when pressurized during the lifting operation and for drawing ambient air therethrough the vent and for retracting the piston when the chamber is depressurized when the object is lowered.

The third aspect is a special case of the first aspect and second aspects of this invention with additional features. According to a third aspect of the invention a pneumatic jack for changing a tire on a motor vehicle is disclosed. A handle is pivotally attached to and cooperatively engaged with a housing for manipulatively placing said pneumatic jack in an operative position relative to the motor vehicle to be lifted and a base is attached to the housing for further assisting in slidably positioning and for stabilizing the pneumatic jack in an operative position relative to the motor vehicle being lifted.

DETAILED DESCRIPTION OF PREFERRED EMBODIMENTS

Figure 1:
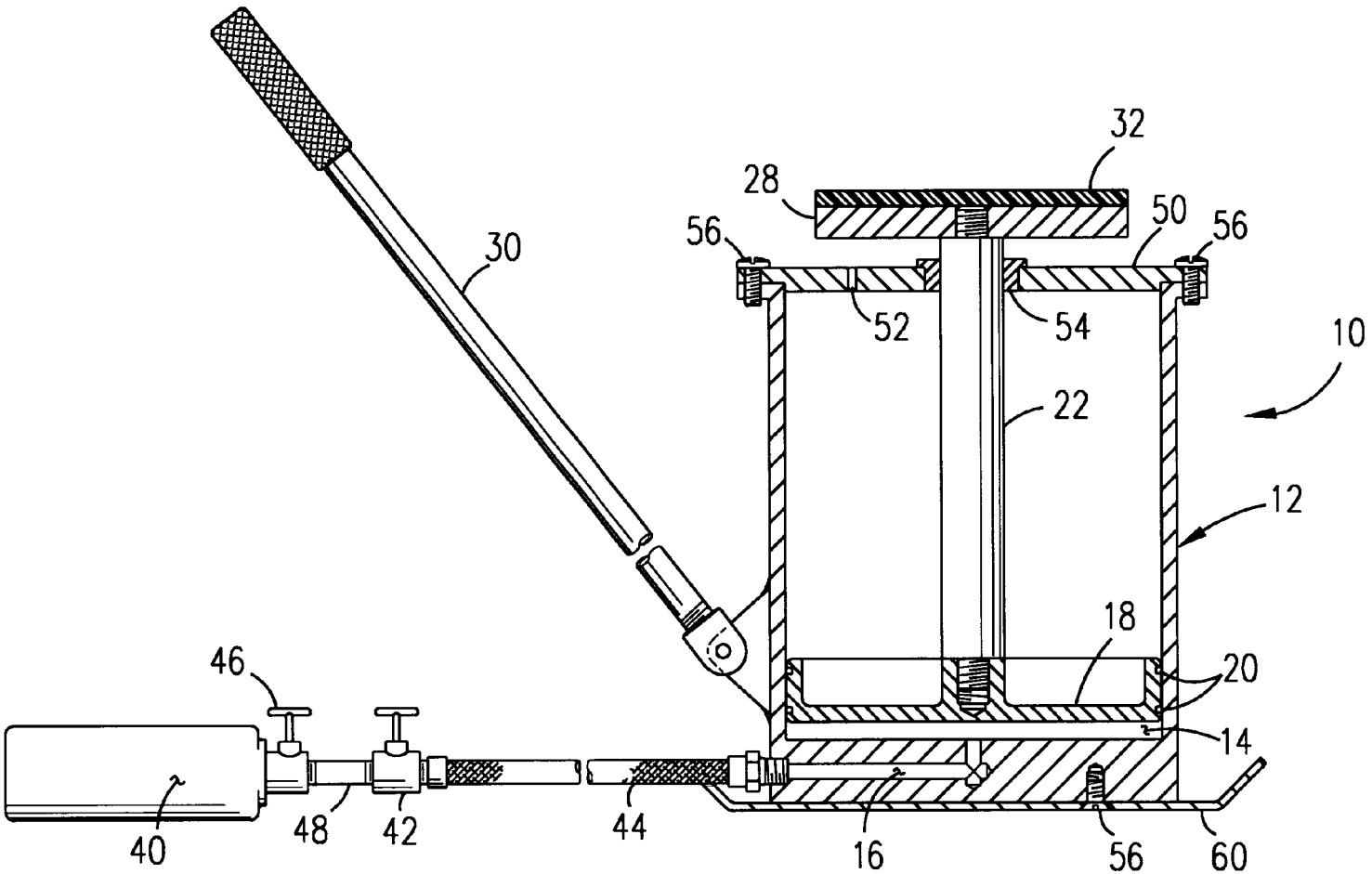
FIG. 1 is a sectional view of a preferred embodiment of a pneumatic jack of the instant invention.

Looking more particularly at the drawings, there is shown in FIG. 1 a preferred embodiment of a pneumatic jack which is generally indicated at 10, according to a preferred embodiment of the present invention.

FIG. 1 is a sectional view of a preferred embodiment of a pneumatic jack 10 of the instant invention. The major components include a housing 12, having a cover 50 with a vent 52 therein with the cover 50 being removably attached to the housing 12 with a fastener 56, a piston 18, a rod 22 connected between the piston 18 and a lifting element 28 and a container 40 filled with one of compressed gas such as air, CO2, helium and inert gas. It is understood that at least one valve is needed for operation. Preferably the pneumatic jack 10 will function better and safer with a gas fill valve 46 on the container 40 connected to a nipple 48 and to a throttle valve 42 and to a hose 44 for pneumatic actuation of the piston 18 for lifting an object. Container 40 may also have a pressure regulator for safety when refilled or it may be filled at a pre-set pressure at the factory.

The housing 12 has therein, a passageway 16 where the pressurized gas is introduced which is operably cooperating with a chamber 14 where the piston 18 is disposed. The piston 18 has a seal 20 which may be an elastomeric member such as an "O ring" to allow the pressurized gas to act on the piston 18 without leakage thereby so that the piston 18 may lift the rod 22 and the lifting element 28 during operation. The lifting element 28 may have a pad 32 made of rubber attached thereto for increasing friction to prevent slippage. The cover 50 has a bushing 54 therein for supporting and for guiding the rod 22 which freely passes therethrough with the lifting member 28 disposed above the cover 50. The bushing 54 may be made from bronze for wear resistance and to minimize friction. Although not necessary for operation, preferably a handle 30 is pivotally attached to the housing 12 solely for manipulating the housing 12 in an operative lifting position under a motor vehicle for changing a tire. Also, for convenience and for storage, the handle 30 may be separable from the housing 12 and may, preferably be threaded. To make the pneumatic jack 10 more useful, preferably a base 60 may be attached to the housing 12 with the fastener 56 for slidably positioning the pneumatic jack 10 in an operative position and to provide stabilization therefor.

It is understood that the object may be any body in need of lifting such as a shed, a snowmobile and any other type of body and the motor vehicle discussed herein is an automobile, a van, a truck and any other wheeled vehicle.

Figure 2:
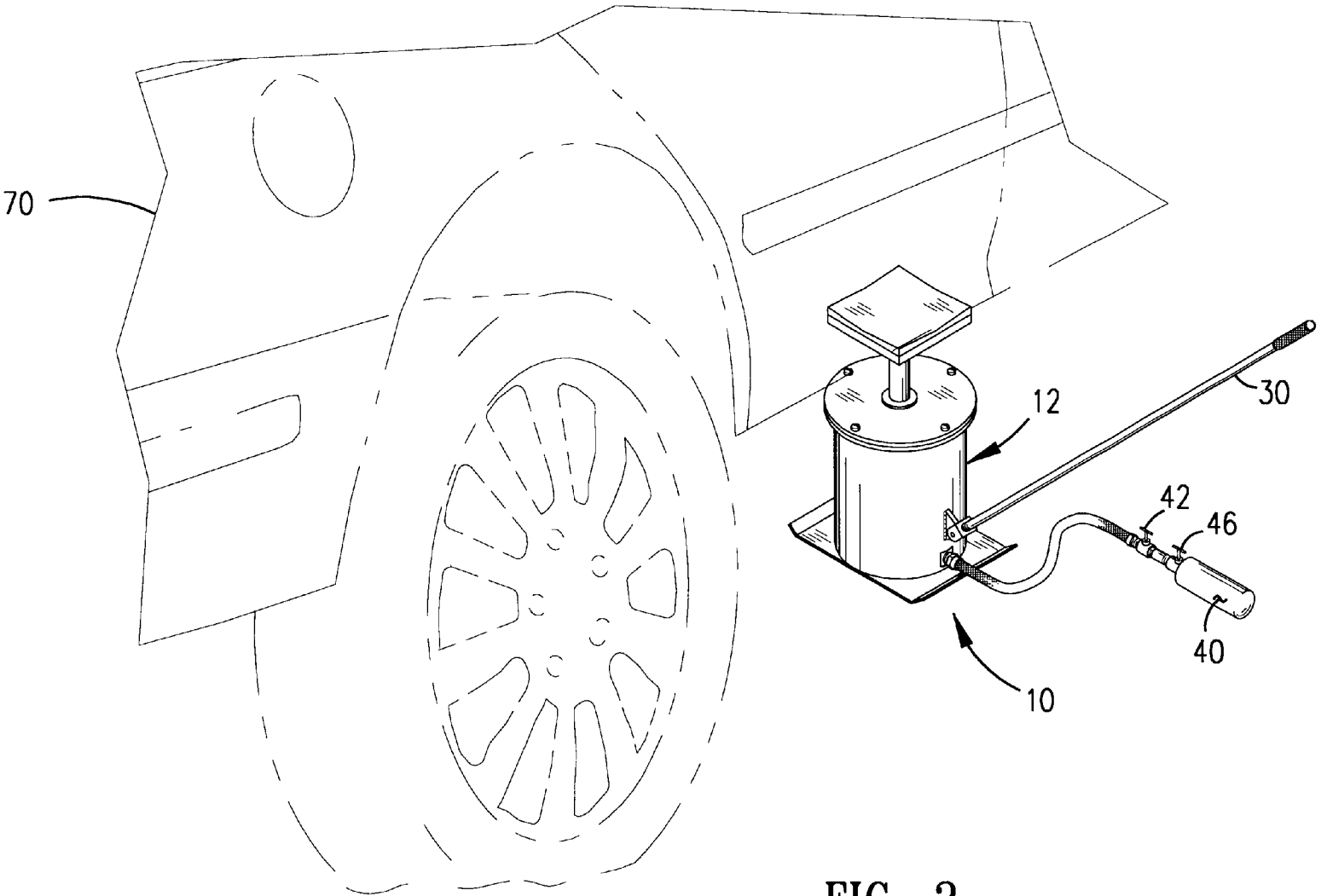
FIG. 2 is a perspective view of the pneumatic jack 10 of FIG. 1 shown in use lifting an automobile, shown in phantom, for changing a tire.

Operation is best understood by referring to FIGS. 1 and 2. The handle 30 is used only to manipulate the pneumatic jack 10 for placement under an automobile 70 near a flat tire and not for lifting as seen in FIG. 2. Initially, both the gas fill valve 46 and the throttle valve 42 are in a closed position. The gas fill valve 46 is opened and pressurized gas from container 40 is allowed to flow when the throttle valve 42 is opened which elevates the automobile 70 a sufficient amount to allow changing of the flat tire. When the automobile 70 is raised to the desired height, the throttle valve 42 and the gas fill valve 46 are manually closed. To lower the automobile 70, the container 40 is removed by unscrewing it from the nipple 48 and the throttle valve 42 is gradually opened to relieve and to purge the pressurized gas to the atmosphere allowing the automobile 70 to be slowly lowered to the ground. Other sequences of operation are within the scope of this disclosure.

The pneumatic jack 10 may be fabricated from readily available materials and by conventional fabrication and assembly techniques. Metal forming and machining operations may be employed for fabrication of the housing 12, cover 50, base 60, handle 30, piston 18, rod 22 and lifting element 28 which, preferably may be made from one of aircraft strength aluminum and steel for strength, for durability, to reduce weight and for ease of fabrication. Hose 44 may be chosen from commercially available high pressure steel reinforced types of hoses. Throttle valve 42 and gas fill valve 46 are commercially available and throttle valve 42, for control, may be a needle valve type. Container 40 may be refillable with available gases such as CO2, air, helium and other inert gasses and having sufficient capacity and volume for the intended purpose.

Surprisingly, the instant invention provides an added advantage and recognizes a problem and adequately and completely addresses an unfulfilled need, in that a pneumatic jack 10, in the manner disclosed, in effect, provides a convenient device which eliminates the need to manually jack an automobile 70 and provides the desired above mentioned advantages and benefits to a user.

It is understood that the pneumatic jack 10 may be constructed in a wide variety of sizes shapes and style variations. For example, the pneumatic jack 10 may be made small enough to be stored in a bag or pouch for convenience. One practical advantage of the invention is that it provides a convenient, practical, low cost, pneumatic jack 10 which allows a user to conveniently lift a vehicle with little effort using pressurized gas. A further advantage of the invention is that the pneumatic jack 10 is designed for ease of manufacture by standard methods and by using readily available materials.

Of course, a wide variety of further uses and advantages of the present invention will become apparent to one skilled in the art.

As disclosed, it is apparent that the instant invention can provide other options. One skilled in the art will realize that the foregoing discussion outlines the more important features of the invention to enable a better understanding of the instant invention and to instill a better appreciation of the inventor's contribution to the art. It must be clear that the disclosed details of construction, descriptions of geometry and illustrations of inventive concepts are mere examples of possible manifestations of the invention.

Although the invention has been shown and described with reference to certain preferred embodiments, those skilled in the art undoubtedly will find alternative embodiments obvious after reading this disclosure. With this in mind, the following claims are intended to define the scope of protection to be afforded the inventor, and those claims shall be deemed to include equivalent constructions insofar as they do not depart from the spirit and scope of the present invention.

What is claimed is:

1. A pneumatic jack comprising:

a housing having a passageway operationally cooperating with a chamber therein;

a cover removably attached to said housing;

a piston slideably disposed within the chamber;

a lifting element disposed above said cover for engagement with an object to be lifted;

a rod attached to said piston and to said lifting element;

said rod freely passing through and guided by a bushing disposed on said cover;

a handle pivotally attached to and cooperatively engaged with said housing for manipulatively placing said pneumatic jack in an operative position relative to the object to be lifted and for removing said pneumatic jack from the operative position after the object has been lowered; and means for pneumatically actuating said pneumatic jack to raise and to maintain the object in an elevated position wherein said actuating means includes a container with a gas fill valve and said container having a pressurized gas therein and a nipple connected between said gas fill valve and a throttle valve for introducing the pressurized gas into the passageway and into the chamber via a hose disposed between said throttle valve and said housing adjacent to the passageway.

2. The pneumatic jack of claim 1 wherein said container is removably attached to said nipple to allow said container to be refilled, as needed, with the pressurized gas chosen from the group consisting of CO2, air and helium and to allow the object to be lowered from an elevated position when said gas fill valve is closed and when said container is removed from said nipple and said throttle valve is opened.

3. The pneumatic jack of claim 2 wherein said cover has a vent therein for purging residual air trapped in the chamber above said piston and between said cover when pressurized during the lifting operation and for drawing ambient air therethrough the vent for retracting said piston when the chamber is depressurized when the object is lowered.

4. The pneumatic jack of claim 3 further comprising a base attached to said housing for slidably positioning and for stabilizing said pneumatic jack in an operative position relative to the object being lifted.

5. The pneumatic jack of claim 4 wherein said pneumatic jack is substantially made from one of aluminum and steel.

6. The pneumatic jack of claim 4 wherein said handle is detachable from said housing for storage.

7. A pneumatic jack for changing a tire on a motor vehicle, said pneumatic jack comprising:

a housing having a passageway operationally cooperating with a chamber therein;

a cover removably attached to said housing;

a piston slideably disposed within the chamber;

a lifting element disposed above said cover for engagement with an object to be lifted;

a rod disposed between said piston and said lifting element;

said rod fixed to said piston and to said lifting element;

said rod freely passing through and guided by a bushing disposed on said cover;

a handle pivotally attached to and cooperatively engaged with said housing for manipulatively placing said pneumatic jack in an operative position relative to the motor vehicle to be lifted so that the tire may be changed and for removing said pneumatic jack from the operative position after the motor vehicle has been lowered and the tire has been changed; and means for pneumatically actuating said pneumatic jack to raise and to maintain the motor vehicle in an elevated position while the tire is being changed wherein said actuating means includes a container with a gas fill valve and said container having a pressurized gas therein and a nipple connected between said gas fill valve and a throttle valve for introducing the pressurized gas into the passageway and into the chamber via a hose disposed between said throttle valve and said housing adjacent to the passageway.

8. The pneumatic jack of claim 7 wherein said container is removably attached to said nipple to allow the motor vehicle to be lowered from the elevated position when said gas fill valve is closed and when said container is removed from said nipple and said throttle valve is opened and to allow said container to be refilled, as needed, with the pressurized gas chosen from the group consisting of CO2, air and helium and wherein said cover having a vent therein for purging residual air trapped in the chamber above said piston and between said cover when pressurized during the lifting operation and for drawing ambient air therethrough the vent and for retracting said piston when the chamber is depressurized when the motor vehicle is lowered.

9. The pneumatic jack of claim 8 further comprising a base attached to said housing for slidably positioning and for stabilizing said pneumatic jack in an operative position relative to the object being lifted.

* * * * *